US005907306A

United States Patent [19]

Karabinis et al.

[11] Patent Number: 5,907,306

[45] Date of Patent: May 25, 1999

[54] RETRACTABLE RADIOTELEPHONE ANTENNAS AND ASSOCIATED RADIOTELEPHONE COMMUNICATION METHODS

[75] Inventors: Peter D. Karabinis; Yawei Ma; Stanley L. Reinhold, all of Cary, N.C.

[73] Assignee: Ericsson Inc., Research Triangle Park, N.C.

[21] Appl. No.: 08/777,042

[22] Filed: Dec. 30, 1996

[51] Int. Cl.[6] ..... H01Q 1/24; H01Q 1/36

[52] U.S. Cl. ..... 343/702; 343/895; 343/901

[58] Field of Search ..... 343/702, 895, 343/900, 901, 906; H01Q 1/24, 1/36

[56] References Cited

U.S. PATENT DOCUMENTS

| | | | |
|---|---|---|---|
| 2,894,260 | 7/1959 | Ellis | 343/745 |
| 3,579,241 | 5/1971 | Antista | 343/901 |
| 4,008,479 | 2/1977 | Smith | 343/895 |
| 4,780,727 | 10/1988 | Seal et al. | 343/895 |
| 4,868,576 | 9/1989 | Johnson, Jr. | 343/702 |
| 5,079,558 | 1/1992 | Koike | 343/901 |
| 5,138,331 | 8/1992 | Josypenko | 343/702 |
| 5,198,831 | 3/1993 | Burrell et al. | 343/702 |
| 5,346,300 | 9/1994 | Yamamoto et al. | 343/860 |
| 5,374,937 | 12/1994 | Tsunekawa et al. | 343/702 |
| 5,504,494 | 4/1996 | Chatzipetros et al. | 343/702 |
| 5,535,435 | 7/1996 | Balzano et al. | 455/89 |
| 5,583,519 | 12/1996 | Koike | 343/702 |
| 5,710,567 | 1/1998 | Funke | 343/702 |
| 5,757,336 | 5/1998 | Matsuoka | 343/702 |
| 5,757,337 | 5/1998 | Hsueh et al. | 343/901 |

FOREIGN PATENT DOCUMENTS 0 715 369 A1 5/1996 European Pat. Off. .

OTHER PUBLICATIONS

Clark, R.A. et al., Series and Parallel–fed Linearly Polarized Helical Aerials, *The Radio and Electronic Engineer*, pp. 67–71 (Jul. 1964).

*Primary Examiner*—Don Wong
*Assistant Examiner*—Tan Ho
*Attorney, Agent, or Firm*—Myers Bigel Sibley & Sajovec, P.A.

[57] ABSTRACT

A multi-piece retractable radiotelephone antenna and associated communication method is employed to provide improved signal quality. The multi-piece antenna includes conductive windings, such as helical quadrafillar windings, disposed separately on two slidably cooperating substrate members. The antenna is mechanically extended to a deploy position and the separate windings are electrically connected thereby doubling the effective electrical length of the antenna.

23 Claims, 8 Drawing Sheets

FIG. 5
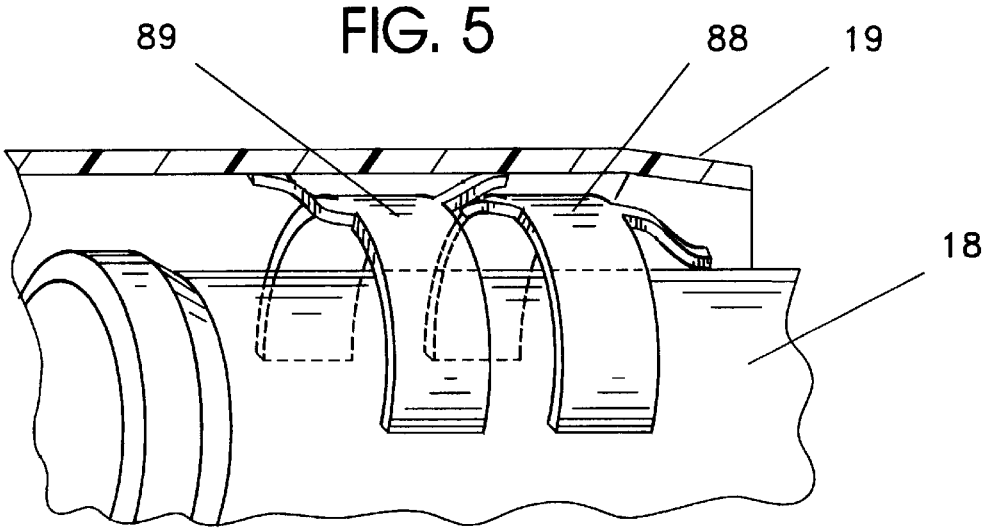
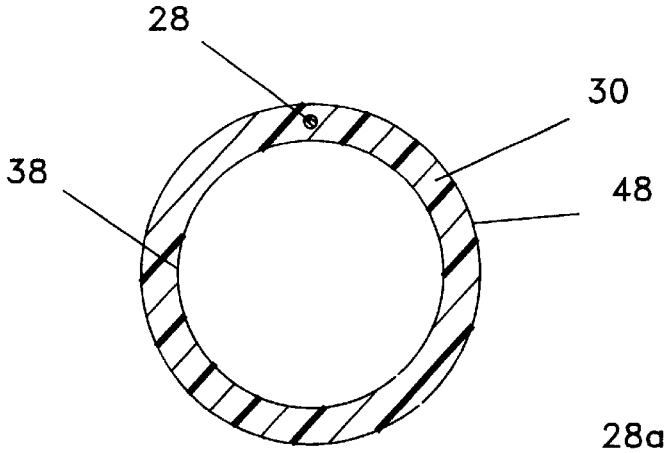
FIG. 6
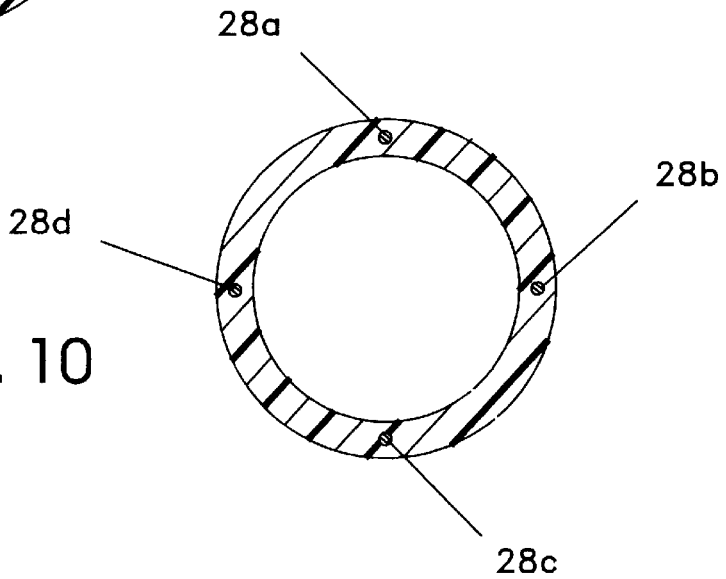
FIG. 10

RETRACTABLE RADIOTELEPHONE ANTENNAS AND ASSOCIATED RADIOTELEPHONE COMMUNICATION METHODS

FIELD OF THE INVENTION

The present invention relates to telephones, and more particularly relates to portable radiotelephones.

BACKGROUND OF THE INVENTION

Portable radiotelephones are becoming a preferred mode of communication which is increasingly relied on, for example, by business users when they are away from the office. Conveniently, increasing numbers of radio-towers and satellite systems are each increasing a user's ability to be available for almost constant communication even in rural or remote areas. This increased popularity produces a sophisticated consumer who demands sometimes competing product specifications or criteria. For example, desired performance parameters typically include improved signal quality, durability, and superior aesthetic qualities all the while shrinking the size of the portable radiotelephone to improve its transportability.

In operation, portable radiotelephones transmit and receive signals from a source such as a transmission tower or satellite. This tower or satellite is typically positioned at a site which is remote from the user of the portable radiotelephone. It will be appreciated that generally the further away a signal is from its transmission source, the weaker the signal and the higher the potential for noise to be introduced into the signal. Thus, a successful portable radiotelephone typically must have the ability to detect, receive, and relay a potentially weak distant signal without increasing the power in the phone to extreme levels while also shielding the signal from undesirable noise contamination.

Further, as noted above, many of the more popular hand-held telephones are undergoing miniaturization. Indeed, many of the contemporary models are only 11–12 centimeters in length. While the aesthetic features and transportability of the radiotelephones can be improved by these reduced dimensions, the miniaturized telephone may further complicate the ability of the telephone to adequately increase the signal to compensate for transmittal distances. This is especially true for a satellite communication based system.

In the past, portable satellite radiotelephones have employed helix antennas such as quadrafillar helix antennas to help achieve acceptable signal quality. Quadrafillar helix antennas utilize four spaced-apart filament elements which are wound around an antenna's surface. Preferably, the filament elements are positioned to be equally spaced around the circumference of the antenna. Unfortunately, although these type of antennas may provide adequate performance, there remains a need to further improve the signal quality while also providing a durable, aesthetically pleasing radiotelephone.

OBJECTS AND SUMMARY OF THE INVENTION

It is an object of the present invention to provide portable radiotelephones with improved signal capability.

It is a further object of the present invention to provide durable and aesthetically pleasing radiotelephones.

These and other objects, advantages and features are provided by multi-piece retractable portable radiotelephone antennas having multiple conductive windings. In particular, a first aspect of the present invention is a retractable antenna for use with a portable radiotelephone which includes a base member having a first insulating substrate and a retractable member having a second insulating substrate slidably attached to the base member. The base member and retractable member define a retracted stow position and at least one extended deploy position wherein the retractable member is slidably outwardly extendable relative to the base member. The base member includes a first conductor winding disposed in a first pattern on the first insulating substrate. The retractable member includes a second conductor winding disposed in a second pattern on the second insulating substrate. The first and second patterns on each of the members are arranged to electrically connect and align when the retractable member is in a deploy position, thereby extending the effective electrical length of the antenna.

Advantageously, the retractable multi-piece antenna of the present invention provides improved signal performance capability in an aesthetically pleasing and durable configured radiotelephone. Further, the multi-piece antenna enables conductive windings to be electrically connected in an extended deploy position which increases the effective electrical length of a small portable radiotelephone.

In a preferred embodiment, a radiotelephone antenna is configured to include two mating cylindrical sleeves. In particular, the radiotelephone antenna includes a cylindrical inner sleeve with an outer surface and a cylindrical outer sleeve with an inner surface. The outer sleeve is slidably attached to the inner sleeve. The sleeves are attached such that they define a retracted stow position and at least one extended deploy position, wherein the outer sleeve is slidably outwardly extendable relative to the inner sleeve. At least one first conductor winding is preferably disposed in a first helical pattern on the inner sleeve and at least one second conductor winding is preferably disposed in a second helical pattern on the outer sleeve. The first and second conductor windings are configured to electrically contact one another via contacts disposed in predetermined positions on the inner and outer sleeves. Accordingly, when the outer sleeve is in a deploy position, first and second contacts engage and electrically connect the first and second conductor windings. Further, when electrically connected, the first and second helical patterns are arranged in a substantially continuous helical pattern, thereby extending the effective electrical length of the antenna.

The first and second helical patterns preferably have the same geometry. More preferably the windings on each sleeve are quadrafillar windings.

The radiotelephone antenna is preferably rotatably attached to a radiotelephone housing by a rotatable hinge. Additionally and advantageously, in a preferred embodiment, the antenna is extendable to about twice the length of the housing.

Radiotelephone communication methods according to the invention use a retractable antenna with conductive windings disposed thereon to communicate between a satellite and a radiotelephone. A radiotelephone signal is received at the radiotelephone from the satellite. In response to the signal, a retractable multi-piece antenna is rotated from a stowed position to an upwardly extendable position. The multi-piece antenna is also upwardly extended. Mating electrical contact surfaces in the multi-piece antenna are engaged to increase the effective electrical length of the windings relative to a non-extended position. A communication signal is then transmitted to the satellite.

Preferably, when the antenna is extended, the multi-piece antenna is aligned so as to arrange the windings to form a substantially continuous pattern. The first and second conductive windings are thus electrically connected and provide increased electrical lengths of the antenna which allows for improved radiotelephone performance in a durable and aesthetically appealing configuration. The foregoing and other objects and aspects of the present invention are explained in detail in the specification set forth below.

BRIEF DESCRIPTION OF THE DRAWINGS

FIG. 5 is an enlarged partial section view taken along lines 5—5 of FIG. 3 illustrating one embodiment of electrical contacts according to a multi-piece retractable antenna of the present invention;

FIG. 6 is a top section view of one embodiment of an antenna according to the present invention illustrating a conductive winding disposed intermediate of the outer and inner surfaces of an antenna sleeve;

FIG. 10 is an enlarged section view taken along lines 10—10 in FIG. 9 illustrating quadrafillar windings which are positioned equally spaced-apart around the circumference of an antenna sleeve;

DETAILED DESCRIPTION OF PREFERRED EMBODIMENTS

The present invention will now be described more fully hereinafter with reference to the accompanying drawings, in which a preferred embodiment of the invention is shown. This invention may, however, be embodied in many different forms and should not be construed as limited to the embodiments set forth herein; rather, this embodiment is provided so that this disclosure will be thorough and complete and will fully convey the scope of the invention to those skilled in the art. Like numbers refer to like elements throughout.

In the description of the present invention that follows, certain terms are employed to refer to the positional relationship of certain structures relative to other structures. As used herein, the term "longitudinal" and derivatives thereof refer to the general direction defined by the longitudinal axis of the radiotelephone housing associated with an antenna that extends upwardly and downwardly between opposing top and bottom ends of the radiotelephone when held in the hand of a user. As used herein, the terms "outer", "outward", "lateral" and derivatives thereof refer to the direction defined by a vector originating at the longitudinal axis of the radiotelephone and extending horizontally and perpendicularly thereto. Conversely, the terms "inner", "inward", and derivatives thereof refer to the direction opposite that of the outward direction. Together the "inward" and "outward" directions comprise the "transverse" direction.

Figure 1:
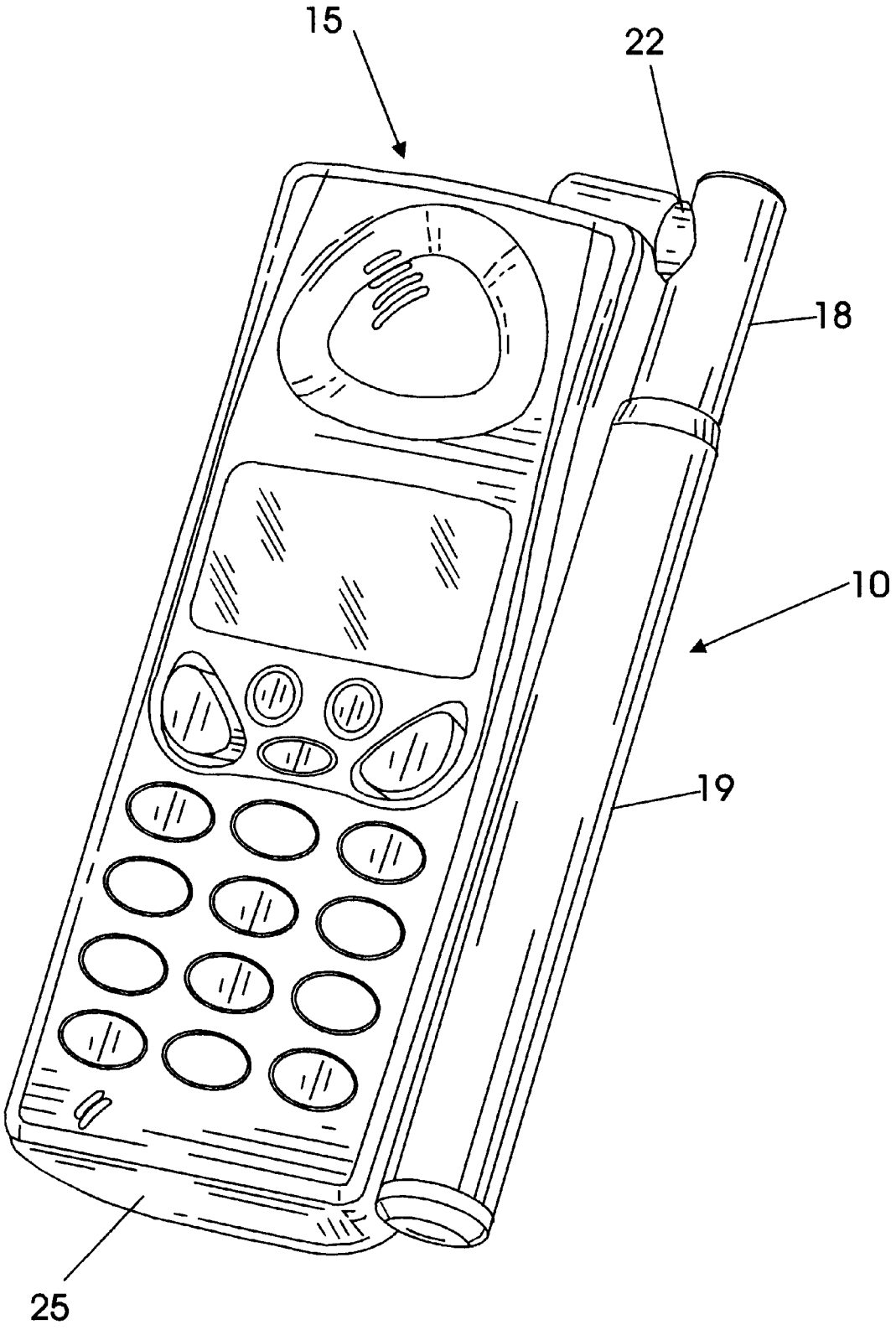
FIG. 1 is a perspective view of a radiotelephone with a retractable antenna in a stowed position according to the present invention.
Figure 2:
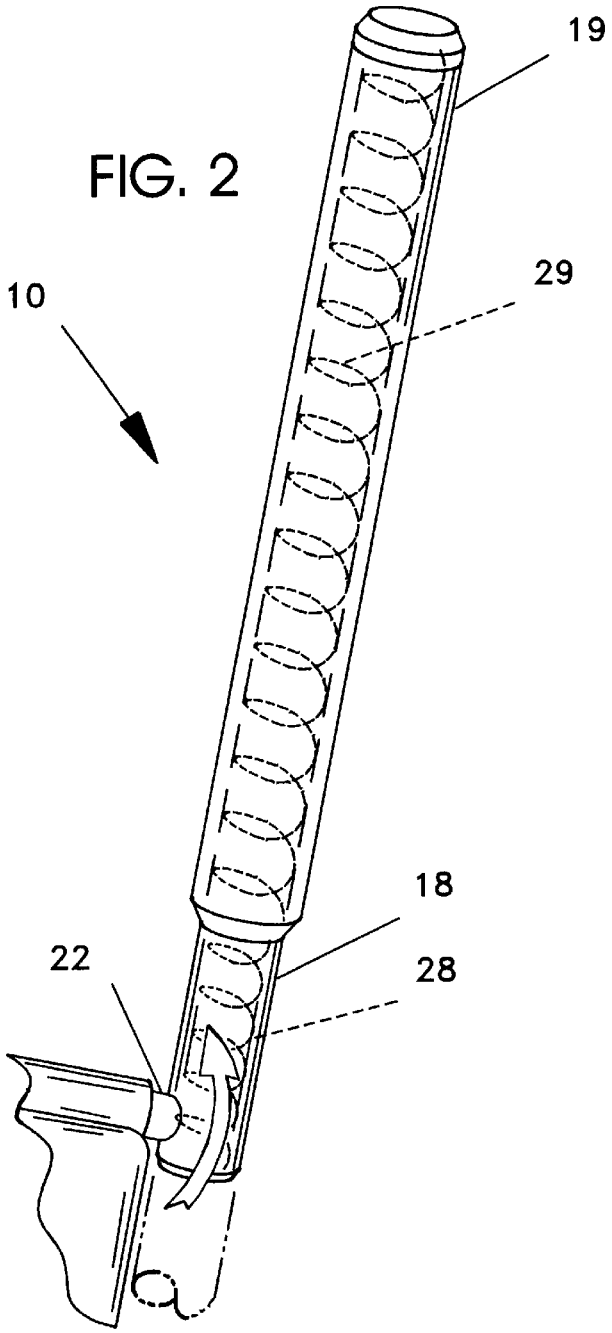
FIG. 2 is a fragmented perspective view of the radiotelephone of FIG. 1 illustrating the rotation of an antenna to a retracted position according to the present invention.
Figure 3:
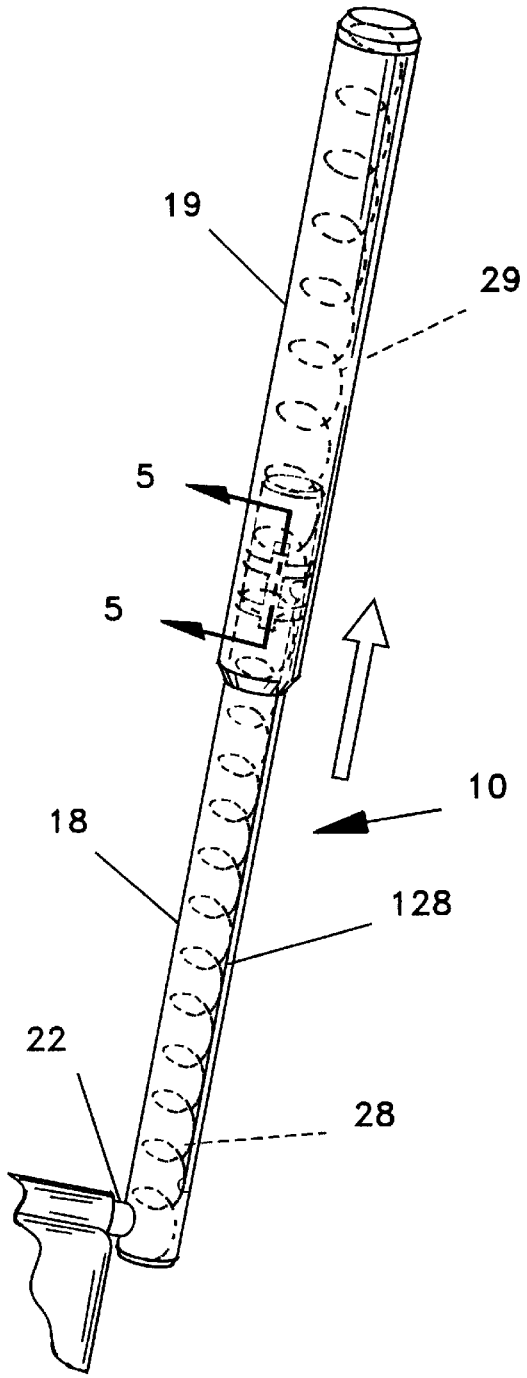
FIG. 3 illustrates the outward extension of the antenna in FIG. 2.

Referring now to the drawings, FIGS. 1–3 illustrate operation of a multi-piece retractable antenna 10 of a radiotelephone 15 according to the present invention. The retractable antenna 10 includes an inner sleeve 18 and a corresponding outer sleeve 19. In FIG. 1, the sleeves 18, 19 are in a stowed position. In order to minimize the antenna's exposure to impact forces when not in operation, it is preferred that in the retracted position, the antenna be positioned to be protected by the radiotelephone housing. For example, as illustrated in FIG. 1, the antenna 10 is rotated and positioned to rest adjacent and substantially coextensive with a side of the radiotelephone. Advantageously, this configuration provides an attractive and aesthetic antenna while also improving the operating characteristics thereof.

In operation, as shown in FIG. 2, when it is desirable to increase the physical and electrical length of the antenna 10, the antenna 10 is rotated upwards via a rotatable hinge 22. Additionally, as illustrated by FIG. 3, the antenna sleeves 18, 19 are telescopically extended in a longitudinal direction to a deploy position thereby increasing both the electrical and physical length of the antenna 10. The deployed length can be much greater than the longitudinal length of the phone housing, such as about double the length of the housing. An exemplary antenna effective length is about 26 centimeters. This increased length improves performance operating parameters such as gain, directivity, and pattern.

As shown in FIGS. 2 and 3, the inner sleeve 18 includes a conductive winding 28. The outer sleeve 19 also includes a conductive winding 29. These windings 28, 29 are positioned on each of the sleeves in a predetermined pattern and are arranged to electrically connect at predetermined positions when the sleeves are extended in a deploy position.

Figure 4:
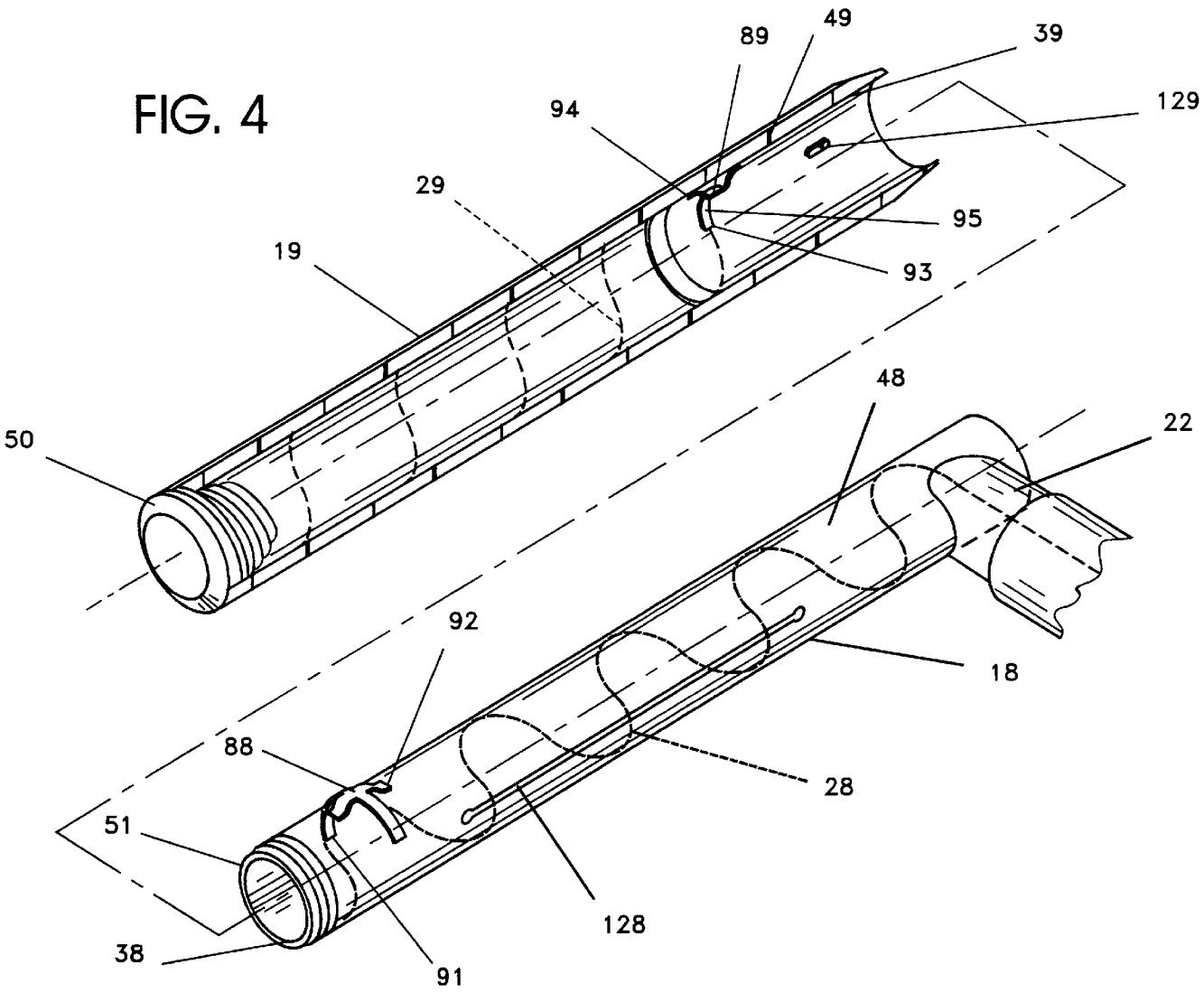
FIG. 4 is a cutaway partial section view of the inner and outer members of an antenna according to one embodiment of the present invention wherein the antenna employs quadrafillar helical windings.

As illustrated in FIG. 5, the electrical contact or connection of the inner and outer sleeves 18, 19 and corresponding conductive windings 28, 29 can be provided by frictional engagement of connectors 88, 89. As illustrated in FIG. 4, an inner sleeve connector 88 is mounted on the outer surface 48 of a forward edge portion of the inner sleeve 18 and is electrically connected to the antenna winding element or filament 28 at a radially extending leg portion 91 of the connector 88. Alternatively, such as when a flex circuit, as will be discussed in further detail hereinbelow, provides the conductive windings 29 it can be disposed around the inner diameter of the sleeve 18 (not shown). In this situation, the connector 88 can include a longitudinal protrusion or flex termination point 92 to connect the inner sleeve antenna element to the connector 88.

Similarly, as shown in FIG. 4, the outer sleeve 19 includes a connector 89 which is disposed on the inner surface 39 of the sleeve 19. The connector is fixedly attached to the inner surface 39 via a radially extending leg 95. As discussed for the inner sleeve connector 88, electrical contact with the winding element(s) 29 is provided at a radial end portion 93 of the connector 89. Alternatively, such as for a flex circuit winding, the electrical connection can be positioned at a longitudinal protrusion or flex termination point 94 of the connector, or by the flex circuit itself.

It is preferred that the sleeve connectors 88, 89 be dual-action connectors so as to enable both a structurally fixed mechanical length of the sleeves as well as an electrical contact in a deploy position, thereby allowing positional and electrical stability. However, the invention is not limited thereto, and any number of electrical and mechanical connections can be employed within the scope of the present invention. Further, as will also be appreciated by one of skill in the art, the shape of the connector is not limited to that shown in FIGS. 4 and 5. Indeed, any number of alternative connector configurations and electrical contacts can yield acceptable electrical and mechanical interconnections between the sleeves 18, 19 and their associated windings 28, 29.

Figure 8:
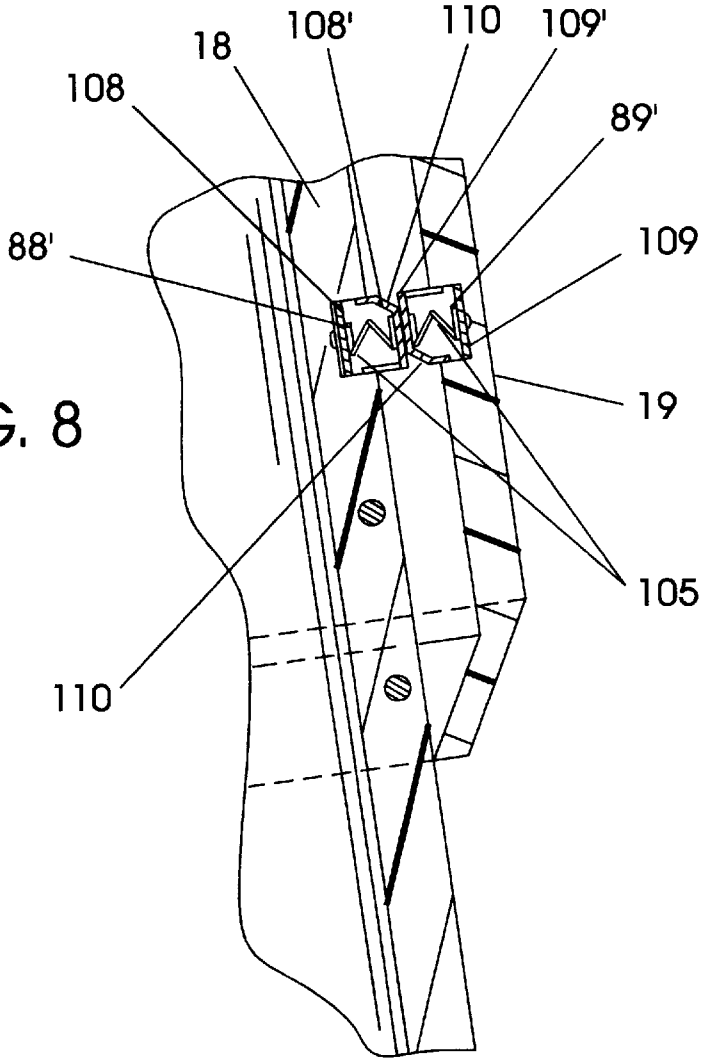
FIG. 8 is an enlarged section view taken along lines 8—8 in FIG. 7 illustrating an alternative embodiment of frictional engagement electrical contact points according to the present invention.
Figure 7:
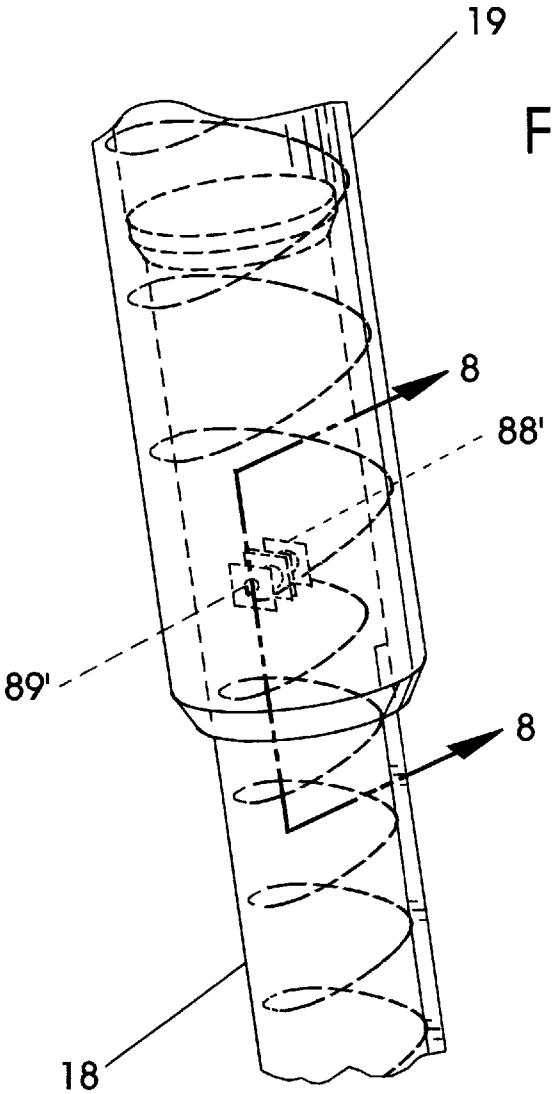
FIG. 7 is a fragmented perspective view of an alternative embodiment of an electrical contact according to the present invention.

One alternative embodiment of mating connectors 88', 89' is illustrated in FIGS. 7 and 8. In this embodiment, the inner sleeve connector 88' and the outer sleeve connector 89' are frictionally engaged at a predetermined alignment point. In operation, the outer sleeve 19 is slidably advanced from a stowed or retracted position until the connectors 88', 89' contact and engage. In position, the springs 105 disposed in the connectors 88', 89', contact and push against the opposing connector and sleeve thereby providing frictional engagement therebetween. The connectors 88', 89' have an antenna element contact 108, 109, respectively, as well as mating electrical contact surfaces 108', 109'. As illustrated in FIG. 8, it is preferred that the connectors 88', 89' include a ramped portion 110 for assisting in the sliding movement of the sleeves 18, 19 in both the extend and retract direction. Additionally, one or more of the sleeves 18, 19 may have a plurality of longitudinally spaced-apart or discrete contact points enabling intermediate electrical contacts corresponding to intermediate deploy positions which can adjustably electrically lengthen the antenna windings 28, 29.

The connectors 88, 89 provide a capacitive coupling or electrical connection between the inner sleeve and outer sleeve windings 28, 29 completing a continuous electrical path between the windings 28, 29, thereby potentially doubling the effective electrical length of the antenna. In an exemplary embodiment, the electrical contact of the sleeves 18, 19 increases the total conductive winding length of the antenna 10 up to about 26 centimeters.

Figure 9:
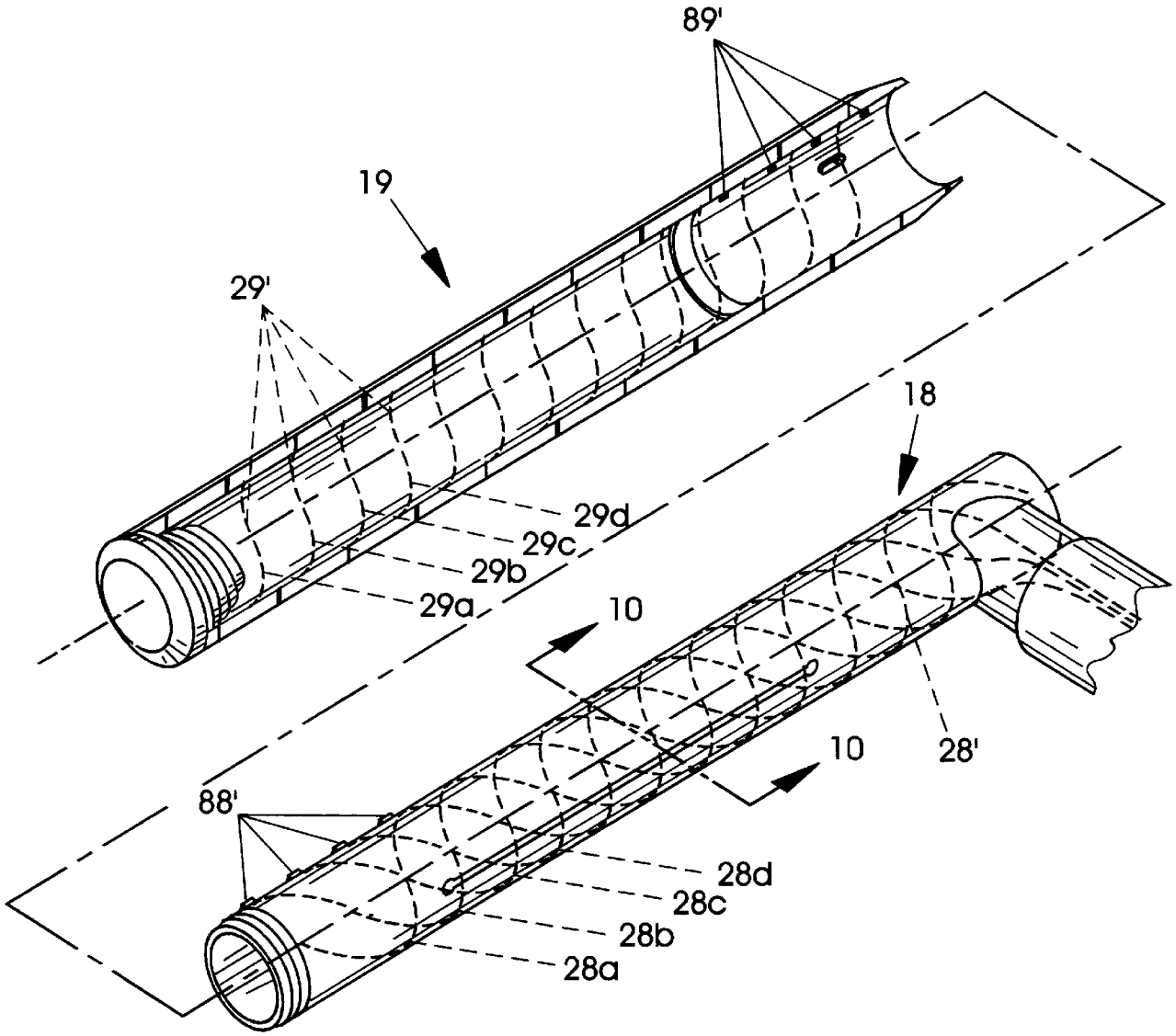
FIG. 9 is a cutaway partial section view of the inner and outer members of an antenna according to one embodiment of the present invention wherein the antenna employs quadrafillar helical windings.

It is preferred that the conductive windings 28, 29 be disposed on the sleeves 18, 19 in a helical pattern and that each of the windings 28, 29 have the same geometrical pattern. As illustrated in FIG. 9, it is more preferred that the windings be formed in a helix quadrafillar pattern 28', 29'. Of course, those of skill in the art will recognize that the windings can be employed in a number of alternative configurations, such as but not limited to, zig-zag, toroid, or other periodic and preferably continuous repeating pattern having a predetermined periodic frequency. Additionally, the windings 28, 29 can include single, bifillar, trifillar, quadrafillar, or up to about eight or more individual filaments or elements.

The windings are attached to the sleeves to expose the windings 28, 29 at predetermined extension points or deploy positions. As such the windings can be provided on the substrate in any number of manners. For example, the conductor element or winding can be positioned on the inner 38 or outer surface 48. Alternatively, as illustrated in sectional view in FIG. 6, the conductive windings 28, 29 can be internally disposed intermediate of the inner or outer surfaces or covered by a protective material such as plastic or resin. Indeed, the sliding surfaces can be provided with a coating which both protects the windings from wear and corrosion as well as to further facilitate the slidablity of the sleeves.

In any event, the windings 28, 29 are configured on the sleeves 18, 19 so that at least one electrical contact for each winding element on each sleeve is brought to a surface and exposed to provide electrical contact with a corresponding sleeve, such as via a connector at a predetermined location (s).

Discrete electrical connections for each of the windings 28, 29 (FIG. 4) or 28', 29' (FIG. 9) are provided for each of the winding elements. For example, as illustrated in FIG. 9, the outer sleeve includes four electrical contact points 89', one for each of the quadrafillar winding elements on the outer sleeve 29*a*, 29*b*, 29*c*, 29*d*. Similarly, the inner sleeve includes four contact points 88' on the corresponding to each of the quadrafillar winding elements 28*a*, 28*b*, 28*c*, 28*d*.

As illustrated in FIG. 9, the contacts 88', 89' on the sleeves are longitudinally aligned in a collinear manner. However, the contact points for each of the winding elements can be disposed on the sleeves in alternative configurations, for example each of the discrete winding element contacts can be brought to the surface such that the corresponding connectors or electrical contacts are symmetrically disposed around the circumference of the sleeve.

As illustrated in FIG. 10, each of the winding elements 28*a*, 28*b*, 28*c*, 28*d* and respective electrical contacts are positioned in a coplanar manner and spaced-apart around the circumference of the sleeve 28, and preferably the electrical contacts are equally spaced-apart relative to the other winding element contacts on the sleeve. Alternatively, one of the sleeves 18, 19 can have collinear contacts while the other has corresponding but circumferentially spaced-apart contacts. A mechanical stop on one or more of the sleeves can provide the proper alignment to engage the electrical contacts at predetermined positions (not shown), thereby allowing many alternative configured mechanical stops and electrical contacts between corresponding windings.

Preferably, the physical length of each of the windings is the same for each of the antenna sleeves, as measured independent of the antenna, i.e., as separate components in a stretched (non-coiled) position. Thus, it is also preferred that the winding elements and associated contacts are positioned when assembled to enable substantially equal physical lengths for each of the windings.

Further, it will be appreciated by one of skill in the art, that, in operation, when the radiotelephone is in a paging mode (before the outer sleeve 19 is deployed), the outer sleeve is typically not electrically connected with the inner sleeve. Therefore, the inner sleeve antenna component determines the gain in this mode. Accordingly, it is preferred that the inner sleeve 18 electrical winding end points (and associated contacts) are circumferentially spaced-apart so as to allow maximum electrical lengths of the winding elements when the antenna is retracted or stowed which, in turn, can improve the operating characteristics of the radiotelephone in this position. Thus, in one preferred embodiment the inner sleeve 18 and the outer sleeve 19 each have corresponding circumferentially spaced-apart coplanar and discrete electrical contacts.

The conductive windings 28, 29 are disposed on an insulating substrate (the sleeves 18, 19), thereby forming a pattern of conductor and insulator. Examples of acceptable insulating substrate antenna material include but are not limited to, plastics, polymers, resins, and the like. Preferably, pliable conductive materials are used for the conductive windings 28, 29. Examples of suitable pliable materials are copper or aluminum. Alternatively, the windings can be manufactured from flex circuit materials which are printed onto a tape. In this embodiment, the tape is rolled and formed in a cylindrical shape in a predetermined diameter so as to fit the diameter of the sleeve. The antenna element material or winding is positioned inside the sleeve. The flex circuit contacts the opposing sleeve flex circuit such as via electrical connector(s) affixed to the antenna sleeves. The electrical connectors can be attached to the sleeve by conventional manufacturing techniques such as by soldering, or brazing onto the antenna elements. The electrical connectors are exposed to enable electrical contact or coupling of the windings together. Accordingly, the physical contact points of the connectors are preferably coated with a wear and oxidation resistant coating or plating such as gold.

In a preferred embodiment, as illustrated in FIG. 1, the antenna is configured to slidably advance and retract so that physical orientation of the windings are maintained in a predetermined path during deployment so that the electrical contacts are held in predetermined alignment. As such, as best illustrated in FIGS. 3 and 4, the inner sleeve 18 is configured with slots 128 on opposing sides of the sleeve 18. Corresponding protrusions 129 are provided on the inner surface 39 of the outer sleeve 19. Thus, in this embodiment, the sleeves 18, 19 are slidably extendable in a linear path relative to the other such that they are not free to rotate. Examples of alternative fixed path extensions include, but are not limited to, the outer sleeve being configured with a track and the inner sleeve with mating protrusions, other tongue and groove or track configurations, and the like. Alternatively, the sleeves can be left free to rotate during deployment and subsequently oriented to align with the mating electrical contact surfaces once in the deploy or lock position.

The antenna can also include an end cap 50. The end cap is configured to engage with the forward end 51 of the inner sleeve 18 when the antenna is in the stow or retracted position. Advantageously, this configuration stops the retraction of the outer sleeve and locks the sleeves together into a structurally secure stow position.

Although the drawings illustrate the antenna 10 attached to the radiotelephone housing 25 via a rotatable hinge 22, one of skill in the art will recognize that the present invention is not limited thereto. The antenna can be attached to the housing in any number of known fastening techniques while still providing a retractable antenna according to the present invention. Examples of additional fastening mechanisms include but are not limited to bayonet type fasteners, mating threaded components, and the like.

Although the multi-piece antenna is illustrated throughout as having cylindrical shaped inner and outer sleeves with the outer sleeve positioned to extend from the inner sleeve, the invention is not limited thereto. For example, the inner sleeve can be the extendable member while the outer sleeve remains stationary. Further, any number of alternative sleeve or member configurations can be employed as long as at least one of the members is extendable and the multiple antenna pieces can engage to extend the effective electrical length of the antenna.

As described above, when the antenna 10 is stowed, the outer sleeve 19 conductive material may be electrically isolated from the inner sleeve 18 active radiotelephone components. Accordingly, the gain of the phone is typically poor in this position. However, the radiotelephone is operable in this position and can receive calls. It is preferred that when communicating with a remote signal source such as a satellite, as illustrated in FIG. 12, the antenna 10 be fully extended in an active deploy position.

As is known to those of skill in the art, the radiotelephone includes other components commonly used in satellite or cellular communications systems to communicate radiotelephone signals from one location to another. For example, typical components include transmitters, receivers, amplifiers, signal processors, memory, and the like implemented in special purpose analog and/or digital hardware positioned in the radiotelephone.

Figure 12:
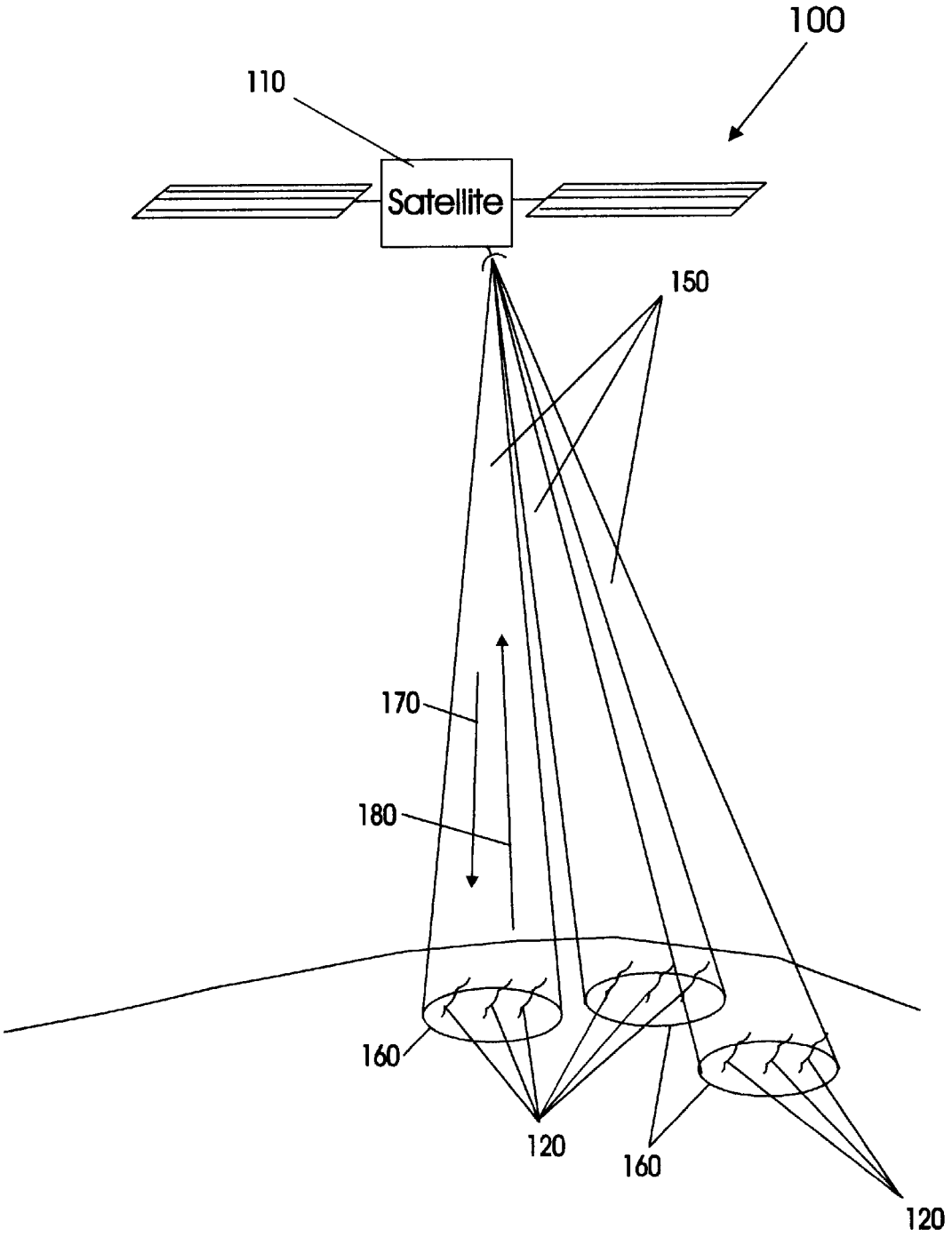
FIG. 12 illustrates the operation of a radiotelephone with a satellite communications system according to the present invention.

As shown in FIG. 12, a satellite radiotelephone system 100 typically includes one or more satellites 110, which may serve as relays or transponders between a central earth station and radiotelephones 120. The satellite radiotelephone system may utilize a single antenna beam covering the entire area served, or, as shown in FIG. 12, the satellite may be designed such that it produces multiple minimally-overlapping beams 150, each serving distinct geographical coverage areas 160 in the system's service region. The satellite typically communicates with a radiotelephone 120 over a bidirectional communications pathway, with radiotelephone communication signals being communicated from the satellite 110 to the radiotelephone 120 over a downlink 170, and from the radiotelephone 120 to the satellite 110 over an uplink 180.

Figure 11:
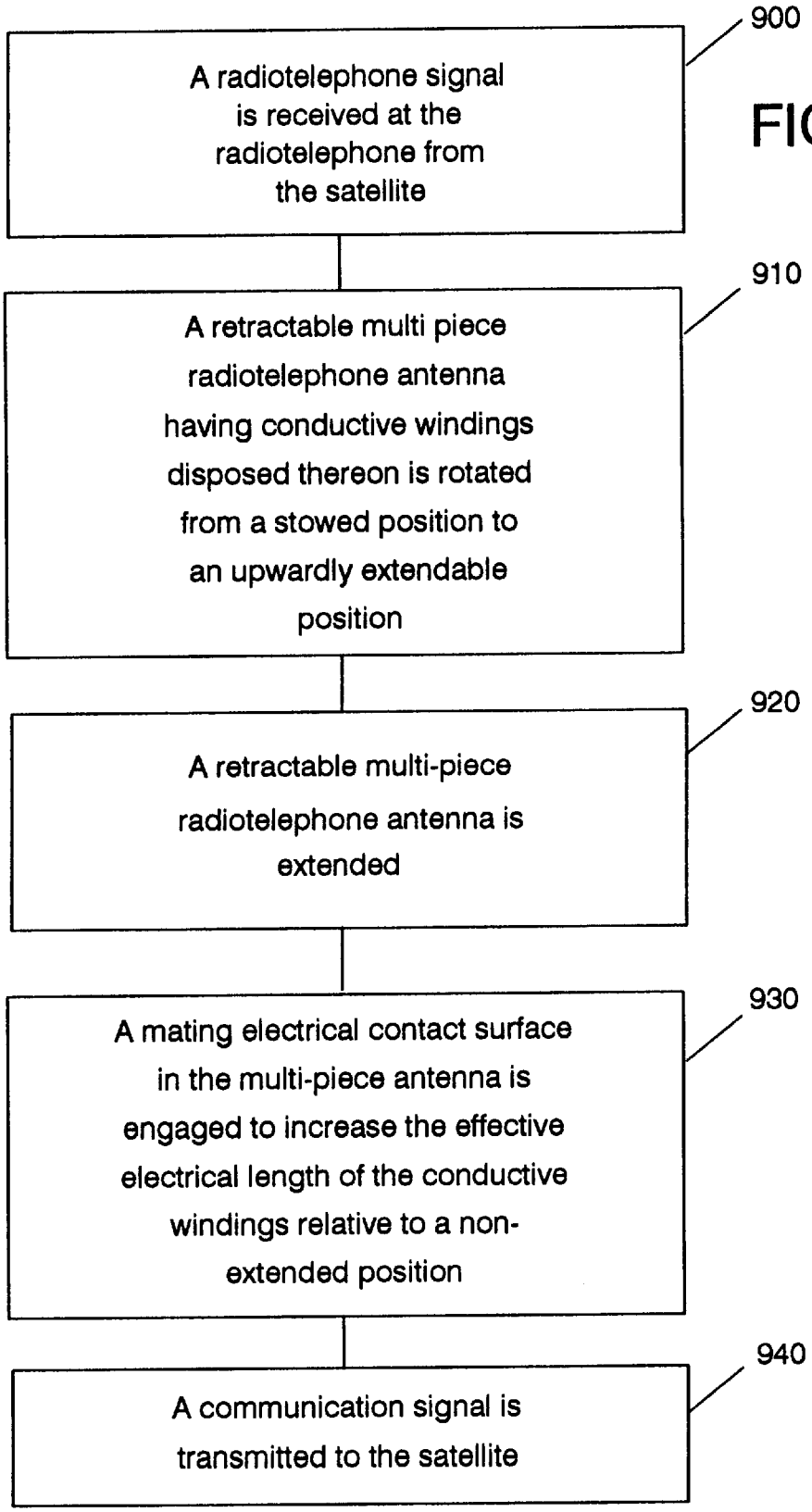
FIG. 11 is a block diagram illustrating a satellite communications system method.

A communication method between a satellite and a radiotelephone employing a retractable antenna having conductive windings disposed thereon is illustrated in FIG. 11. At Block 900, a radiotelephone signal is received at the radiotelephone from the satellite. Block 910 illustrates the step of rotating a retractable multi-piece antenna from a stowed position to an upwardly extendable position. The multi-piece antenna is extended into position (Block 920). Block 930 shows the step of engaging a mating electrical contact surface in the antenna to increase the effective length of the windings relative to a non-extended position. Block 940 illustrates the step of transmitting a communication signal to the satellite.

Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims.

The invention is defined by the following claims, with equivalents of the claims to be included therein.

That which is claimed is:

1. A retractable antenna for a portable radiotelephone, comprising:

a base member having a first insulating substrate;

a retractable member having a second insulating substrate slidably attached to said base member, to define a retracted stow position and at least one extended deploy position, wherein said retractable member is slidably outwardly extendable relative to said base member;

a first conductor filament winding disposed in a first pattern on said first insulating substrate; and a second conductor filament winding disposed in a second pattern on said second insulating substrate, wherein said first and second patterns are arranged to electrically connect and define a conductive winding pattern when said retractable member is in said at least one deploy position, thereby extending the effective electrical length of said antenna.

2. An antenna according to claim 1, wherein said base and retractable member each include at least one corresponding discrete electrical contact point extending therefrom to electrically couple said first and second conductor windings when said retractable member is extended to said at least one deploy position.

3. An antenna according to claim 2, wherein said base and retractable members are slidably extendable in a linear path relative to each other such that they are not free to rotate.

4. An antenna according to claim 1, wherein said first and second conductor windings are first and second quadrafillar conductor windings.

5. An antenna according to claim 4, wherein said first and second patterns are first and second helical patterns.

6. An antenna according to claim 1, wherein said conductor winding effective electrical length in a deploy position is about 26 cm.

7. An antenna according to claim 1, further comprising a rotatable hinge attached to said base member.

8. An antenna according to claim 7, in combination with a radiotelephone housing, wherein said housing and said antenna are rotatably attached by said rotatable hinge.

9. A housing assembly according to claim 8, wherein said retractable antenna is extendable to about twice the length of said housing.

10. A retractable antenna according to claim 1, wherein each of said first and second filament windings have adjacent portions, and wherein said first and second windings are arranged on said first and second substrates such that each is substantially spaced-apart from adjacent portions of said filament winding along the length of said conductive winding pattern.

11. A retractable antenna according to claim 10, wherein said conductive winding are arranged such that the inner diameter of said substrate is continuous.

12. A radiotelephone according to claim 1, wherein when said base member and said retractable member are cylindrical sleeves having inner and outer circumferences, and wherein in said deploy position said first and second winding patterns are continuous and periodically repeat along a major portion of the length of each of said sleeves.

13. A radiotelephone according to claim 12, wherein said first and second filament windings are positioned intermediate said inner and outer circumferences about a major portion of the length of said base and retractable members.

14. A radiotelephone according to claim 13, wherein said first and second windings include discrete contact points for electrically connecting said first and second windings which are positioned on one of said inner and outer circumferences.

15. A retractable antenna for a portable radiotelephone, comprising:

a base member having a first insulating substrate;

a retractable member having a second insulating substrate slidably attached to said base member, to define a retracted stow position and at least one deploy position, wherein said retractable member is slidably outwardly extendable relative to said base member;

a first conductor winding disposed in a first pattern on said first insulating substrate; and a second conductor winding disposed in a second pattern on said second insulating substrate, wherein said first and second patterns are arranged to electrically connect when said retractable member is in said at least one deploy position, thereby extending the effective electrical length of said antenna, wherein said base member includes an outer surface and a discrete electrical contact point positioned on a forward edge portion of said outer surface, and said retractable member includes an inner surface and a plurality of corresponding discrete electrical contact point positioned at predetermined intervals along the length of said inner surface to electrically couple said first and second conductor windings when said retractable member is extended in predetermined deploy positions and thereby adjustably extend the effective electrical length of said antenna.

16. A retractable antenna for a portable radiotelephone, comprising:

a base member having a first insulating substrate;

a retractable member having a second insulating substrate slidably attached to said base member, to define a retracted stow position and at least one deploy position, wherein said retractable member is slidably outwardly extendable relative to said base member;

a first conductor winding disposed in a first pattern on said first insulating substrate; and a second conductor winding disposed in a second pattern on said second insulating substrate, wherein said first and second patterns are arranged to electrically connect when said retractable member is in said at least one deploy position, thereby extending the effective electrical length of said antenna, wherein said retractable member is an outer sleeve which encloses said base member when said retractable member is in the stow position.

17. An antenna for a radiotelephone, comprising:

a cylindrical inner sleeve having an outer surface;

a cylindrical outer sleeve having an inner surface slidably attached to said inner sleeve to define a retracted position and at least one extended deploy position, wherein said outer sleeve is slidably outwardly extendable relative to said inner sleeve;

a first conductor winding disposed in a first helical pattern on said inner sleeve;

a second conductor winding disposed in a second helical pattern on said outer sleeve;

a first conductor winding contact positioned on the outer surface of said inner sleeve; and a second conductor winding contact positioned on the inner surface of said outer sleeve, such that when said outer sleeve is extended in a deploy position said first and second contacts electrically connect said first and second conductor windings, and wherein said first and second helical patterns form a continuous helical pattern, thereby extending the effective electrical length of said antenna.

18. An antenna according to claim 17, wherein said first and second helical patterns have the same geometry.

19. An antenna according to claim 17, wherein said first and second conductor winding are first and second quadrafillar windings, and wherein said first conductor winding contact and said second conductor winding contact are each a plurality of discrete contacts, and wherein one of said plurality of discrete first and second contacts corresponds to a respective one of the elements of said quadrafillar windings.

20. A radiotelephone communication method between a satellite and a radiotelephone, the method comprising the steps of:

receiving a radiotelephone signal at the radiotelephone from the satellite;

rotating a retractable multi-piece radiotelephone antenna having conductive windings disposed from a stowed position to an upwardly extendable position thereon, said conductive windings configured with spaced-apart adjacent portions;

extending the retractable multi-piece radiotelephone antenna;

engaging a mating electrical contact surface in the multi-piece antenna to increase the effective electrical length of the antenna conductive windings relative to a non-extended position; and transmitting a communication signal to the satellite.

21. A communication method according to claim 20, further comprising the step of aligning the multi-piece antenna to arrange the conductive windings to form a substantially continuous pattern.

22. A communication method according to claim 20, wherein the conductive windings are helical quadrafillar windings.

23. A radiotelephone communication method according to claim 20, wherein the multi-piece antenna comprises two portions, an upper portion and a lower portion, and wherein said extending step is performed by sliding the upper portion over the exterior of the lower portion.

* * * * *